US007815775B2

(12) United States Patent
Phillips et al.

(10) Patent No.: US 7,815,775 B2
(45) Date of Patent: Oct. 19, 2010

(54) OPTIMIZED COKE CUTTING METHOD FOR DECOKING SUBSTANTIALLY FREE-FLOWING COKE IN DELAYED COKERS

(75) Inventors: Glen E. Phillips, Goldvein, VA (US); Charles John Mart, Baton Rouge, LA (US)

(73) Assignee: ExxonMobil Research & Engineering Company, Annandale, NJ (US)

( * ) Notice: Subject to any disclaimer, the term of this patent is extended or adjusted under 35 U.S.C. 154(b) by 532 days.

(21) Appl. No.: 11/892,701

(22) Filed: Aug. 27, 2007

(65) Prior Publication Data

US 2009/0057126 A1 Mar. 5, 2009

(51) Int. Cl.
*C10B 47/00* (2006.01)
*B08B 7/00* (2006.01)

(52) U.S. Cl. ..... 201/1; 201/2; 201/3; 134/18; 134/39

(58) Field of Classification Search ..... 201/1, 201/2, 3; 208/131; 702/56; 134/18, 39
See application file for complete search history.

(56) References Cited

U.S. PATENT DOCUMENTS

| | | | | |
|---|---|---|---|---|
| 4,410,398 | A * | 10/1983 | Chipman et al. | 201/1 |
| 5,022,268 | A * | 6/1991 | Wolf et al. | 73/602 |
| 6,772,094 | B2 * | 8/2004 | Tyson | 702/183 |
| 7,340,985 | B2 * | 3/2008 | Claesson et al. | 82/163 |
| 7,374,665 | B2 * | 5/2008 | Eppig et al. | 208/131 |
| 7,594,996 | B2 * | 9/2009 | Colic | 208/391 |
| 2007/0038393 | A1 * | 2/2007 | Borah et al. | 702/56 |

* cited by examiner

*Primary Examiner*—N. Bhat
(74) *Attorney, Agent, or Firm*—Glenn T. Barrett

(57) ABSTRACT

A method for coke removal in delayed coker drums is provided. The method comprises the steps of draining from the drum of substantially free-flowing coke, performing a vibration signature analysis on the drum to identify whether and where any coke remains attached to the interior wall of the drum after the draining step, and cutting the coke from the areas identified by the signature analysis step.

20 Claims, 1 Drawing Sheet

Figure 1:
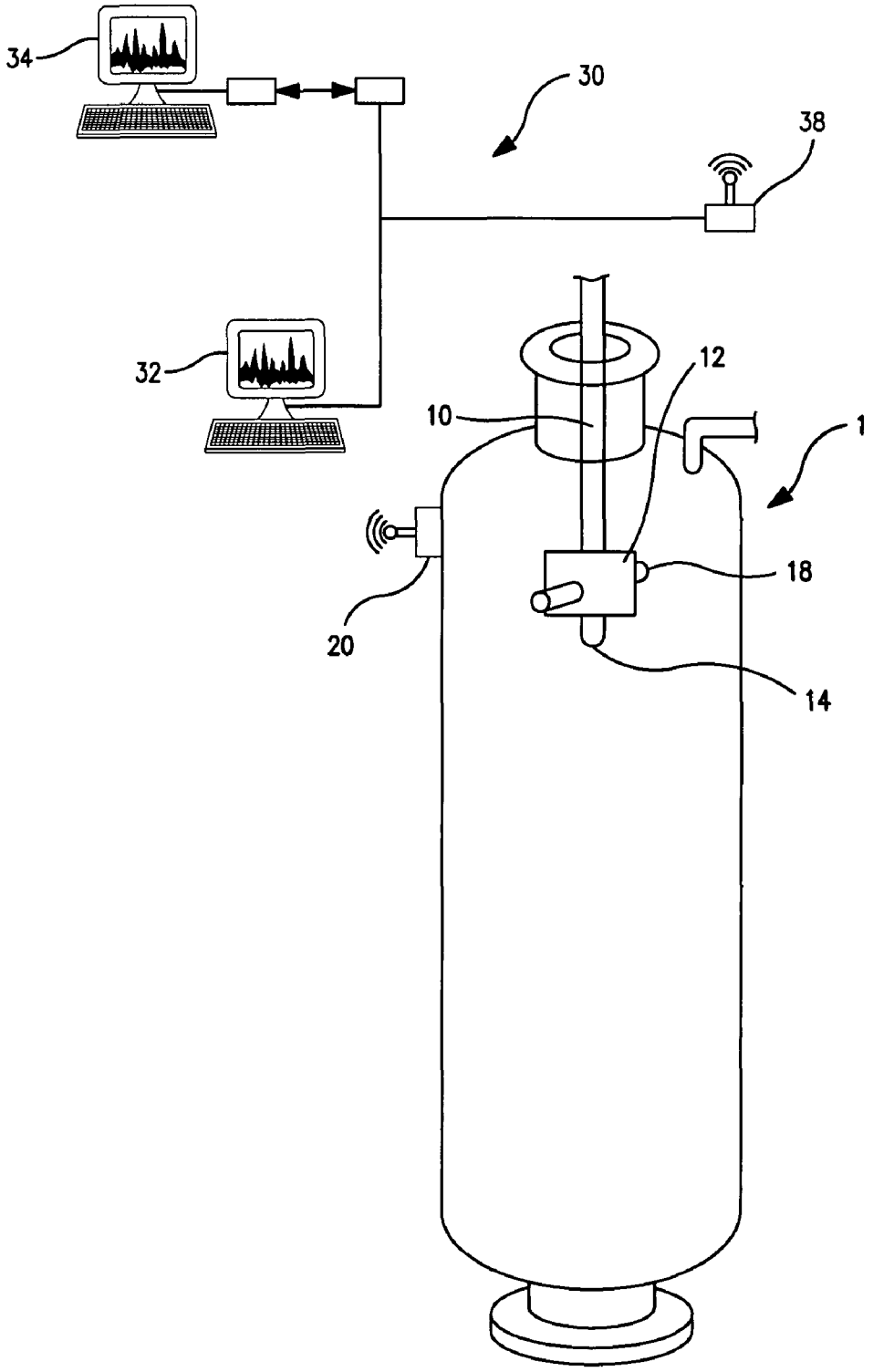

OPTIMIZED COKE CUTTING METHOD FOR DECOKING SUBSTANTIALLY FREE-FLOWING COKE IN DELAYED COKERS

1.0 BACKGROUND OF THE INVENTION

1.1 Field of the Invention

The invention relates to coke cutting methods in delayed cokers. More particularly, the invention relates to a method for determining whether and where coke cutting is required using vibration signature analysis.

1.2 Description of Related Art

Delayed coking is a process for the thermal conversion of heavy oils such as petroleum residua (also referred to as "resid") to produce liquid and vapor hydrocarbon products and coke. Delayed coking of resids from heavy and heavy sour (high sulfur) crude oils is carried out by converting part of the resids to more valuable liquid and gaseous hydrocarbon products. The resulting coke has value, depending on its grade, as a fuel (fuel grade coke), electrodes for aluminum manufacture (anode grade coke), etc.

In the delayed coking process, the feed is rapidly heated at about 500° C. (932° F.) in a fired heater or tubular furnace. The heated feed is conducted to a coking vessel (also called a "drum") that is maintained at conditions under which coking occurs, generally at temperatures above about 400° C. (752° F.) and super-atmospheric pressures. Coke drums are generally large, upright, cylindrical, metal vessels, typically ninety to one-hundred feet in height, and twenty to thirty feet in diameter. Coke drums have a top portion fitted with a top head and a bottom portion fitted with a bottom head. Coke drums are usually present in pairs so that they can be operated alternately. Coke accumulates in a vessel until it is filled, at which time the heated feed is switched to the alternate empty coke drum. While one coke drum is being filled with heated residual oil, the other vessel is being cooled and purged of coke.

The heated feed forms volatile species including hydrocarbons that are removed from the drum overhead and conducted away from the process to, e.g., a fractionator. The process also results in the accumulation of coke in the drum. When the first coker drum is full of coke, the heated feed is switched to a second drum. Hydrocarbon vapors are purged from the coke drum with steam. The drum is then quenched with water to lower the temperature to a range of about 93° C. to about 148° C. (about 200° F. to about 300° F.), after which the water is drained. When the cooling step is complete, the drum is opened and the coke is removed by drilling and/or cutting. The coke removal step is frequently referred to as "decoking".

Current coke cutting practices for delayed coker drums require the drilling of a pilot hole to create a passage to the bottom outlet of the drum, followed by stepwise cutting of the coke bed from the top to the bottom of the drum. A cutting/boring tool is located on a drill stem that conducts water to nozzles on the tool which create water jets. A hole is typically bored in the coke by water jet nozzles oriented vertically on the head of the cutting/boring tool. Similarly, nozzles oriented horizontally on the head of the cutting/boring tool cut the coke from the drum. The coke is typically cut from the drum using a low speed (with rpm around 15-20), high impact water jet. The coke removal step adds considerably to the throughput time of the process. Drilling and removing coke from the drum takes approximately 1 to 6 hours. The coker drum is not available to coke additional feed until the coke removal step is completed, which negatively impacts the yield of hydrocarbon vapor from the process. Coke cutting is typically a manually controlled process with the individual running the cutting system relying on visual appearance of the drum discharge and, to a lesser extent, on audible clues from contact of the cutting water with the drum wall.

Recently, various methods have been developed by ExxonMobil Research and Engineering Company (EMRE) for generating coke in a substantially free-flowing form, such as a free flowing shot coke, which is more easily removed from the drum. (See, e.g., US 2003/0102250; US 2004/0256292; US 2005/0284798; US 2006/0006101; US 2006/0060506; and US 2006/0196811.) Substantially free-flowing coke is particularly suited to removal by a decoking process also developed by EMRE referred to as "slurry decoking." (See, e.g., U.S. 2005/0269247.)

In slurry decoking, the coke is formed into a slurry in the coker vessel prior to its removal from the vessel. The slurry is formed when quench water floods the hot coker drum for cooling purposes. In conventional processes, the water would be drained from the coker drum before coke cutting and subsequent coke removal. But in "slurry decoking", contrary to conventional practices, the quench water is allowed to remain in the coker drum after cooling and to form a slurry with the coke. By skipping the traditional drain step, and discharging a coke water fluid, significant savings in cycle time can be achieved, which may translate to higher potential unit throughput.

With the advance of improved methods for generating free-flowing coke, and techniques for processing the same such as slurry decoking, the amount of coke required to be cut and the time required for cutting/polishing a drum can be markedly reduced because the bulk of the loose coke formed will be discharged from the drum without having to be cut. Ideally, the cutting step is completely eliminated. However, current expectations and observations are that some cutting is still required to adequately clean the drum for the next cycle in at least some instances. Nonetheless, cutting time is reduced because less coke remains in the drum to be removed.

To maximize these improvements in cycle time, there is a need for a method that identifies whether cutting is or is not required during a given cycle. Furthermore, if cutting is required, there is a need for a method that identifies the specific areas on the drum that require cutting and that targets those areas. Finally, it would be desirable to have a method of controlling coke cutting that eliminates the need for operators to rely on their subjective, and inherently uncertain and variable, assessment of the process based visual appearance and audio clues.

2.0 BRIEF DESCRIPTION OF THE DRAWINGS

The following drawings are for illustrative purposes only and are not intended to limit the scope of the present invention in any way:

FIG. 1 illustrates an example of a measurement system for performing the methods of the present invention.

3.0 SUMMARY OF THE INVENTION

In one embodiment, the present invention provides a method for determining whether a coke drum is clean by performing a vibration signature analysis on the coke drum to identify whether and where coke remains attached to the walls of the drum.

Preferably, the method is employed in coking operations that generate a substantially free-flowing shot coke and, more preferably, in conjunction with slurry decoking.

In another embodiment, the method comprises the steps of draining from the drum of substantially free-flowing coke, performing a vibration signature analysis on the drum to identify whether and where there are areas on the drum where coke remains attached to the interior wall of the drum after the draining step and cutting the coke from the areas identified by the signature analysis step.

The vibration signal analysis determinations can be done by an operator stationed at a computer at a local or remote location. Alternatively, the entire method can be fully automated. In either case, the method not only reduces time between cycles, but also reduces the manpower required and the uncertainty inherent in relying on an operator's visual inspection or audio determination. In addition the method maximizes throughput/process capacity by assuring that the entire drum will be empty and ready for the next cycle.

4.0 DETAILED DESCRIPTION

4.1 Substantially Free-Flowing Coke

A method for coke removal in delayed coker drums is provided. In one embodiment, the coke is a substantially free-flowing coke. The term "free-flowing" as used herein means that the coke morphology is such that about 500 tons to about 900 tons of the coke, plus any interstitial water or other liquid present therein, can be drained in less than about 30 minutes through a 60-inch (152.4 cm) diameter opening. The preferred coke morphology (i.e., one morphology that will produce substantially free-flowing coke) is a coke microstructure of discrete micro-domains having an average size of about 0.5 to 10 μm, preferably from about 1 to 5 μm. Typically, free-flowing coke is shot coke, but not all shot coke is free-flowing. There are a number of techniques that can be used, either alone and in combination, to initiate and enhance the production of a substantially free-flowing coke morphology.

One technique is to choose a resid that has a propensity for forming shot coke. Such feeds include, for example Maya, Cold Lake. Resid feedstocks can also be blended to enhance the production of free flowing coke. (See, e.g., US 2005/02484798 entitled "Blending of Resid Feedstocks to Produce a Coke that is Easier to Remove from a Coker Drum," the entirety of which is incorporated herein by reference.)

Another technique is to take a deeper cut of resid off of the vacuum pipestill to make a resid that contains less than about 10 wt. % material boiling between about 900° F. (482° C.) and 1040° F. (560° C.) as determined by high temperature simulated distillation. (See, e.g., US 2006/0006101 entitled "Production of Substantially Free-Flowing Coke From a Deeper Cut of Vacuum Resid in Delayed Coking," the entirety of which is incorporated herein by reference.)

Another technique is to utilize acoustic energy to enhance the desired coke morphology. (See, e.g., 2006/0196811 entitled "Influence of Acoustic Energy on Coke Morphology and Foaming in Delayed Coking.)

In addition, certain additives can be utilized to increase the propensity of a resid to yield a substantially free-flowing coke. (See, e.g., US 2003/0102250 entitled "Delayed Coking Process for Producing Anisotropic Free-flowing Shot Coke," US 2004/0256292 entitled "Delayed Coking Process for Producing Free-Flowing Coke Using A Substantially Metals-Free Additive," US 2004/0262198 entitled "Delayed Coking Process for Producing Free-Flowing Shot Coke Using A Metals-Containing Additive," US 2005/0263440 entitled "Delayed Coking Process for Producing a Free Flowing Coke Using Polymeric Additives," US 2005/0279673 entitled "Delayed Coking Process for Producing Free-Flowing Coke Using An Overbased Metal Detergent Additive," and US 2006/0060506 entitled "Delayed Coking Process," each of which is incorporated herein by reference in its entirety.)

4.2 Slurry Decoking

Preferably, the free-flowing coke is formed into a slurry by the addition of water. More preferably the free-flowing coke is shot coke that is formed into a slurry by the addition of quenching water. Accordingly, in one preferred embodiment, the invention is applied to drums being decoked by "slurry decoking." Slurry decoking is described, for example, in US 2005/0269247 entitled "Production and Removal of Free-Flowing Coke from Delayed Coker Drum," the entirety of which is hereby incorporated by reference.

Generally, in "slurry decoking," drum cycle time is reduced by approximately 25% through the production of loose coke (i.e., shot coke) which can be drained from the coke drum with the quench water. Eliminating the drain step and shortening the cutting step results in the reduction in cycle time. Slurry decoking keeps more interstitial water in the coke. In "slurry decoking," any of the above described techniques can be used to obtain a coke product wherein the bulk morphology is such that at least 30 volume percent of the coke is free-flowing under gravity or hydrostatic forces. Preferably at least about 60 volume percent of the bulk morphology is free-flowing, more preferably at least about 90 volume percent, even more preferably at least about 95 volume percent and ideally the entire bulk morphology is free-flowing. When only 60 volume percent or less of free-flowing coke is present, and particularly when only 30 volume percent of free-flowing coke is present, it is best if the free-flowing coke is at the lower section of the coke drum so that it can be discharged as a slurry with water before the other coke (e.g., sponge coke) is drilled from the drum.

4.3 Vibration Signature Analysis

Ideally, all of the free flowing coke flows out of the drum when it is emptied. In many instances, however, the drum is not clean—and therefore not ready to put back on line to coke additional feed because a significant amount of residual coke remains attached to the wall of the drum. In such instances, the residual coke attached to the interior wall of the drum must be cut from the drum to obtain a clean drum that is ready to be used for the next batch of feed.

The determination of whether the drum is clean after the draining of the free flowing coke is made by performing a vibration signature analysis on the coke drum. The vibration signature analysis identifies whether coke remains attached to the wall of the drum after draining. If substantially no coke remains attached to the wall, the drum is clean; if areas with coke are identified, the coke is cut from the areas to obtain a clean drum.

Vibration signature analysis, as used in the present invention, is based on the general principle that if a vibration of a known frequency is induced on a drum, it will produce a standard signature unless its structure has been changed. That is, a clean drum will consistently produce the same vibration signature; if the structure of the drum is changed it will produce a different vibration than that of the drum in the clean condition. In the context of delayed coking, the structure of the drum is changed, and therefore produces a different vibration signature, whenever there is residual coke remaining on the wall of the drum. The vibration signature analysis can be performed using standard equipment for obtaining and analyzing vibration signatures.

The vibration signature analysis is used to determine whether a coker drum drained of coke is clean and ready for the next cycle or whether any areas on the drum still have coke attached to the interior wall. As a prerequisite to performing an analysis, a vibration signature of the drum in a clean condition must first be obtained, herein referred to as the standard vibration signature. The standard vibration signature is obtained by mechanically inducing a vibration and measuring the response, herein referred to as "ringing," a clean drum. While the drum can be rung by any means, in one embodiment, a simple and effective set up of an air-actuated or spring loaded cylinder is employed to drive a steel rod against a target plate welded to the external drum wall. The measured response (i.e., the standard vibration signature) is sent and stored in the computer system.

The vibration signature analysis is performed each time after the drum is used in a delayed coking process. Once the drum is used in a delayed coking process, it is drained of coke. As described above, preferably the coke is made into a slurry and drained. Once the draining is complete, it is unknown whether or not the drum is clean. At this point a vibration signature of the drained or emptied drum is obtained. The emptied drum vibration signature is obtained by mechanically inducing a vibration (or alternately referred to as "ringing") the emptied drum in the same manner as was done to generate the standard vibration signature. The response is measured and again sent to the computer system.

The emptied drum vibration signature is then compared to the standard vibration signature. Preferably the comparison is performed by the computer by way of pattern recognition software. However, any method can be used that compares the two signatures and can accurately determine if the signatures are the same or different. For example, the two signatures can even be analyzed by a visual comparison.

The vibration signature analysis compares the two signatures and identifies the differences between the two signatures. Typically, limits are pre-defined as to how much variation or differences there can be between the standard vibration signature and the emptied drum vibration signature. This pre-defined limit is preferably incorporated into the computer system programming so that when the pattern recognition software performs the comparison, the results are analyzed to determine whether the emptied drum is within the pre-defined limits.

The result of the vibration signature analysis dictates the next step in the method. If the analysis finds that the emptied drum is in clean condition, then the drum is ready to be used in the next coking cycle. If the analysis indicates that the drum is not clean then a vibration signature profile is obtained of the drum to determine the areas of the drum that need cleaning.

4.4 Vibration Signature Profile

If the analysis indicates that the drum is not clean then the vibration signature analysis continues by obtaining a vibration signature profile of the drum. Again, this is only necessary if the signature of the drum, when compared to a clean condition signature, is outside of predefined limits. The vibration signature profile is obtained by passing the drill stem down the entire height of the drum in cut mode. Cut mode is when the jet of water from the drill stem is directed to the walls. In traditional use, where the entire surface of the wall is covered with coke, cut mode is used to cut out coke from the wall of the drum and can be time consuming in order to clean the entire drum. In contrast, as used herein, only a single, relatively quick pass of the drill stem in cut mode is needed to obtain a drum signature.

As the drill stem travels down through the drum a series of signatures is obtained. The drill stem travels at a known constant rate down the drum and vibration measurements are taken at known intervals as the drill stem travels. As a result, the signatures, which are obtained as a function of time, provide a series of signatures that correspond to specific heights on the drum. This series of signatures together form what is herein referred to as a vibration signature profile.

In one embodiment, a signature is obtained every 5 feet along the height of the drum. This provides a reasonable limit on the amount of data to be processed. In another embodiment, there is continuous capture of signature and analysis. In some embodiments, the water jet from the drill impacts an area about a foot in length on the wall and, in such cases, the practical value of measuring very small increments (e.g., less than a foot) may be limited.

In operation, the drill stem in cutting mode is passed quickly down the entire height of the drum. Quickly means that the operation is much faster than it would be passed if the drill stem were actually being used to cut coke. Instead, the drill stem in cut mode shoots a jet of water which is directed to the walls of the drum in order to induce vibrations, which are then measured. The vibration signature produced by the drill as it travels down the drum produces the vibration profile. The drum signature profile can be obtained by a single pass of a drill stem in cutting mode.

The analysis compares the signatures in the profile to other signatures in the profile. The analysis does not compare the signatures in the profile to the standard signature. The analysis identifies signatures from the profile that are different from signatures at adjacent positions in the profile. For example, if the signature at position A on the drum is different from adjacent position B (hereinafter referred to as a shift), then that indicates that there is a change in structure between position A and B. In practical terms, that means that there is coke remaining on the wall of the drum between positions A and B. Alternatively, if no coke is between position A and B, then the signature for A and B will be the same, or substantially the same.

The analysis continues and each region between adjacent signatures is examined and compared for the presence of a shift in the vibration signatures. The existence of a shift corresponds to the presence of residual coke attached to the wall of the drum. This process is performed for the entire height of the drum. In this way, the areas requiring cutting to adequately clean the drum are identified.

The analysis can include decision parameters such that only those areas having areas of residual coke which exceed a specified deposit size are identified; and subsequent, or on-line/concurrent, drilling/cutting is directed only at those areas. The choice to include a size parameter is entirely dependant on the requirements of the operation. For example, the size parameter can be set to avoid drum capacity limitations on the succeeding cycle, or possible obstruction of the bottom outlet if it came loose on the thermal cycle.

4.5 Illustrative Vibration Measurement System

One embodiment for a vibration measurement system for performing vibration signature analysis on a coker drum is illustrated in FIG. 1. The system contains the standard components of a decoking system. The decoking system includes a drill stem 10 and a cutting head 12 for cutting coke (not shown) inside a drum 1. Cutting head 12 further comprises nozzles for boring 14 and nozzles for cutting 18. Nozzles for boring 14 are generally downward-facing, and nozzles for cutting 18 are generally horizontally oriented toward the inside wall of the drum 1.

The vibration measuring components comprise a sensor or transducer coupled or attached to at least one position on the outer surface of the drum 1 and operatively connected to a computer system 30. Preferably, the sensor or transducer is an accelerometer 20. It is sufficient to place one accelerometer 20 on the drum 1 to measure the vibrations of the drum, but multiple accelerometers, positioned at multiple locations on the drum 1, can also be utilized. The accelerometer 20 or accelerometers can be placed at any convenient position on the outer surface of the drum 1.

The sensors or accelerometers 20 collect vibration data and the vibration data is preferably transmitted to the computer system 30. Therefore, the main consideration in positioning the accelerometer is that it be capable of collecting vibration data from the drum and transmitting or supplying the collected data to a computer system 30.

The computer system 30 receives data from the accelerometer 20. Preferably the computer system 30 is loaded with pattern recognition software that can analyze the vibration data from the accelerometer 20. The specific setup of the computer system is not critically important so long as it is capable of receiving data and analyzing the data. The computer system 30 may optionally include one or more of the following components: an active repeater (not shown) and a network access point 38. The connections between components within the computer system 30, or to and from the computer system 30, may comprise wired or wireless connections.

Computer system 30 may operate on one or more computers at one or more locations, such as for example, a local computer device 32, a remote computer device 34, and/or another computer device or other component known to those in the art. Computer 32 and/or 36 includes a suitable input device, such as a keypad, mouse, touch screen, microphone, or other device to input or receive information. Computer 32 and/or 36 also includes a suitable output device to convey the information associated with the operation of the computer, such as pattern recognition software, including digital or analog data, visual information, or audio information. Computer 32 and/or 36 may include a fixed or removable storage media, such as magnetic computer disks, CD-ROM, or other suitable media to receive output from and provide input to a database or other application.

In some embodiments of the present invention, the accelerometer 20 measures or has a 0.5 Hz to 20 kHz frequency response with 1 Hz to 40 kHz sampling speed. The accelerometer may have a frequency response beyond these limits however.

The same equipment (e.g., the accelerometer 20 and computer system 30) is used to measure and analyze vibrations for a vibration signature profile.

4.6 Coke Cutting

Once the areas or regions on the wall of the drum with coke attached are identified, the drum is cut. Because the bulk of the loose shot coke formed will be discharged from the drum during the draining of the free-flowing coke, stepwise cutting of the coke bed from top to bottom of the drum is not required as in conventional delayed coking. Instead, in this method, the drill is directed to only those areas identified as having residual coke on the wall. This can be done manually by an operator controlling the drum or it can be completely automated or computer controlled. In one embodiment the drill is automatically directed to the area identified by the analysis and cut. By limiting the cutting in this manner, a significant reduction in the time required to clean the drum results, as compared to cutting the entire drum.

4.7 Alternatives

There will be various modifications, adjustments, and applications of the disclosed invention that will be apparent to those of skill in the art, and the present application is intended to cover such embodiments. Accordingly, while the present invention has been described in the context of certain preferred embodiments, it is intended that the full scope of these be measured by reference to the scope of the following claims.

What is claimed is:

1. A method for coke removal in delayed coker drums comprising:

(i) draining a drum containing substantially free-flowing coke;

(ii) performing a vibration signature analysis on the drum to identify any areas on the drum where coke remains attached to a wall of the drum after draining; and (iii) cutting the coke from the areas on the drum identified by the vibration signature analysis.

2. The method of claim 1, wherein performing the vibration signature analysis comprises:

(i) ringing the drum to induce vibration of the drum;

(ii) measuring the vibration to obtain a ring signature;

(iii) comparing the ring signature with a previously determined clean condition signature of the drum;

(iv) determining if the ring signature varies within predefined limits of the clean condition signature;

(v) obtaining a drum signature profile if the ring signature is determined to vary outside the predefined limits; and (vi) analyzing the drum signature profile to identify areas on the drum where coke remains attached to the wall of the drum.

3. The method of claim 2, wherein the drum signature profile is obtained by:

(i) passing an operating drill stem along a height of the drum; and (ii) measuring vibrations produced by the operating drill stem corresponding to different areas along the height of the drum.

4. The method of claim 3, wherein measuring includes taking a series of measurements of the vibrations, and further wherein adjacent measurements in the series are compared to determine the presence of a shift in the signatures.

5. The method of claim 2, wherein the substantially free-flowing coke is a slurry.

6. The method of claim 5, wherein the slurry is comprised of shot coke and water.

7. The method of claim 2, wherein measuring the ring signature is performed using an accelerometer.

8. The method of claim 2, wherein comparing the ring signatures is performed using pattern recognition software.

9. A method for determining whether a drained coke drum is clean by performing a vibration signature analysis on the drum to identify any areas on the drum where coke remains attached to a wall of the drum.

10. The method of claim 9, wherein the vibration signature analysis comprises:

(i) ringing the drum to induce vibration on the drum;

(ii) measuring the vibration to obtain a ring signature of the drum; and (iii) comparing the ring signature with a previously determined clean condition signature of the drum.

11. The method of claim 10, wherein comparing the signatures is performed using pattern recognition software.

12. The method of claim 11, wherein measuring the vibration is performed using an accelerometer.

13. A method for preparing a delayed coker drum for a new batch of feed after being drained of substantially free-flowing coke comprising:

(i) performing a vibration signature analysis on the drum to identify any areas on the drum where coke remains attached to a wall of the drum;

(ii) cutting the coke from the areas on the drum identified by the vibration signature analysis.

14. The method of claim 13, wherein performing the vibration signature analysis includes:

(i) obtaining a drum signature profile; and (ii) analyzing the drum signature profile to identify the areas on the drum where coke remains attached to the wall of the drum.

15. The method of claim 14, wherein obtaining the drum signature profile includes:

(i) passing an operating drill stem along a height of the drum; and (ii) measuring vibrations produced by the operating drill stem corresponding to different areas along the height of the drum.

16. The method of claim 15, wherein the vibrations are measured by an accelerometer positioned on an outer side of the drum.

17. The method of claim 15, wherein measuring includes taking a series of measurements of the vibrations, and further wherein adjacent measurements in the series are compared to determine the presence of a shift in the signatures.

18. The method of claim 17, wherein cutting is directed toward each area where the presence of a shift is identified.

19. The method of claim 17, wherein comparing the signatures to determine the presence of a shift is performed using pattern recognition software.

20. The method of claim 14, wherein performing the vibration signature analysis further includes determining whether the drum is clean by:

(i) ringing the drum to induce vibration of the drum;

(ii) measuring the vibration to obtain a ring signature; and (iii) comparing the ring signature with a previously determined clean condition signature of the drum.

* * * * *